US007814749B2

(12) United States Patent
Cadman et al.

(10) Patent No.: US 7,814,749 B2
(45) Date of Patent: Oct. 19, 2010

(54) METHOD AND APPARATUS FOR CONTROLLING A HYDRAULIC SYSTEM OF A WORK MACHINE

(75) Inventors: Kristen D. Cadman, Johnston, IA (US); Elizabeth H. Steenbergen, Phoenix, AZ (US)

(73) Assignee: Deere & Company, Moline, IL (US)

( * ) Notice: Subject to any disclaimer, the term of this patent is extended or adjusted under 35 U.S.C. 154(b) by 407 days.

(21) Appl. No.: 12/041,211

(22) Filed: Mar. 3, 2008

(65) Prior Publication Data

US 2009/0220350 A1 Sep. 3, 2009

(51) Int. Cl.
*F15B 13/00* (2006.01)
*E02F 9/22* (2006.01)

(52) U.S. Cl. ..... 60/327; 60/459; 701/50

(58) Field of Classification Search ..... 60/327, 60/427, 431, 459; 701/50
See application file for complete search history.

(56) References Cited

U.S. PATENT DOCUMENTS 4,712,376 A 12/1987 Hadank et al.
5,356,259 A * 10/1994 Hanamoto et al. ..... 414/694
7,225,615 B2 * 6/2007 Bankestad et al. ..... 60/431

* cited by examiner

*Primary Examiner*—Thomas E Lazo
(74) *Attorney, Agent, or Firm*—Taylor IP PC

(57) ABSTRACT

A method for controlling a hydraulic system includes receiving an operator command signal via an operator command input device; receiving a throttle position signal from a throttle; retrieving from a memory a first predetermined correlation between the operator command signal and a corresponding command flow rate; retrieving from the memory a second predetermined correlation between the throttle position signal and a corresponding available flow rate from a hydraulic pump; determining the command flow rate based on the first predetermined correlation and the operator command signal; determining the available flow rate based on the second predetermined correlation and the throttle position signal; and providing a control signal based on the available flow rate and the command flow rate.

20 Claims, 5 Drawing Sheets

METHOD AND APPARATUS FOR CONTROLLING A HYDRAULIC SYSTEM OF A WORK MACHINE

FIELD OF THE INVENTION

The present invention relates to work machines, and, more particularly, to a method and apparatus for controlling a hydraulic system of a work machine.

BACKGROUND OF THE INVENTION

Work machines, such as backhoes, are used in many industries, including the agricultural, construction, and forestry related industries. Typical work machines are employed for performing various heavy tasks, such as moving soil, and lifting and moving bales of hay, pallets, and other heavy items with a hydraulically actuated attachment, such as a bucket. In order to perform work using the attachment, hydraulic cylinders are employed, which are controlled by an operator using control devices, such as joystick levers. Generally, the hydraulic pump employed by work machines is driven by the work machine's engine, and thus, the amount of hydraulic flow deliverable by the hydraulic pump varies with the speed of the engine. In situations where the output of the pump falls below the amount of flow requested by the operator of the work machine, e.g., because engine speed selected by the operator is insufficient for the pump to generate the requested flow, operational difficulties may be encountered. For example instability of the hydraulic system may result, which may adversely affect hydraulic system load handling, and engine recovery and stability.

Hence, it is desirable to be able to control the hydraulic system of a work machine in a manner that promotes stable operation.

SUMMARY OF THE INVENTION

The present invention provides a method and apparatus for controlling a hydraulic system.

The invention, in one form thereof, is directed to a method for controlling a hydraulic system. The hydraulic system includes an engine-driven hydraulic pump and a hydraulic valve arrangement. The method includes receiving an operator command signal via an operator command input device; receiving a throttle position signal from a throttle configured for setting a speed of the engine; retrieving from a memory a first predetermined correlation between the operator command signal and a corresponding command flow rate from the hydraulic valve arrangement; retrieving from the memory a second predetermined correlation between the throttle position signal and a corresponding available flow rate from the hydraulic pump; determining the command flow rate based on the first predetermined correlation and the operator command signal; determining the available flow rate based on the second predetermined correlation and the throttle position signal; and providing a control signal to the hydraulic valve arrangement based on the available flow rate and the command flow rate.

The invention, in another form thereof, is directed to a work machine for performing work with an attachment. The work machine includes an engine; a throttle configured to provide a throttle position signal for setting a speed of the engine; a hydraulic system including an engine-driven hydraulic pump and a hydraulic valve arrangement. The hydraulic system is configured to hydraulically actuate the attachment via the hydraulic valve arrangement. The work machine also includes an operator command input device configured to provide an operator command signal for directing a motion of the attachment; and a controller. The controller includes a memory storing a first predetermined correlation between the operator command signal and a corresponding command flow rate from the hydraulic valve arrangement. The memory also stores a second predetermined correlation between the throttle position signal and a corresponding available flow rate from the hydraulic pump. The controller also includes a processing unit communicatively coupled to the memory, the throttle and the operator command input device. The processing unit is configured to execute program instructions to: receive the operator command signal from the operator command input device; receive the throttle position signal from the throttle; retrieve from the memory the first predetermined correlation and the second predetermined correlation; determine the command flow rate based on the first predetermined correlation and the operator command signal; determine the available flow rate based on the second predetermined correlation and the throttle position signal; and provide a control signal to the hydraulic valve arrangement based on the available flow rate and the command flow rate.

The invention, in yet another form thereof, is directed to a controller for controlling a hydraulic system. The hydraulic system includes an engine-driven hydraulic pump and a hydraulic valve arrangement controlled in response to an operator command signal from an operator command input device. The speed of the engine is set based on a throttle position signal from a throttle. The controller includes a memory storing a first predetermined correlation between the operator command signal and a corresponding command flow rate from the hydraulic valve arrangement. The memory also stores a second predetermined correlation between the throttle position signal and a corresponding available flow rate from the hydraulic pump. The controller also includes a processing unit communicatively coupled to the memory, the throttle and the operator command input device. The processing unit is configured to execute program instructions to: receive the operator command signal from the operator command input device; receive the throttle position signal from the throttle; retrieve from the memory the first predetermined correlation and the second predetermined correlation; determine the command flow rate based on the first predetermined correlation and the operator command signal; determine the available flow rate based on the second predetermined correlation and the throttle position signal; and provide a control signal to the hydraulic valve arrangement based on the available flow rate and the command flow rate.

DETAILED DESCRIPTION OF THE INVENTION

Figure 1:
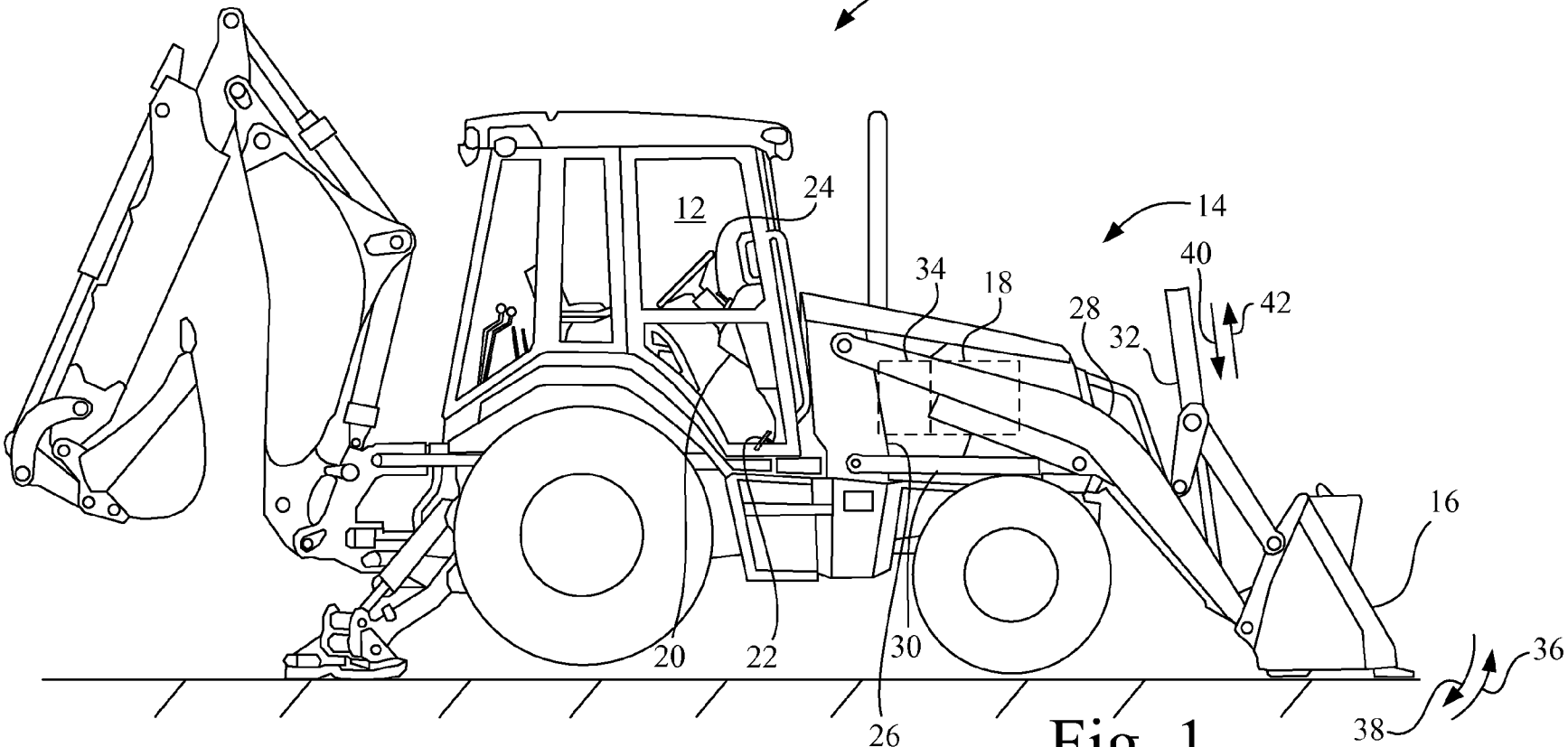
FIG. 1 depicts an exemplary work machine in accordance with an embodiment of the present invention.

Referring now to FIG. 1, there is shown a work machine 10 in accordance with an embodiment of the present invention.

Work machine 10 may be used for performing agricultural, construction, and/or forestry work, and may be wheel driven and/or track driven. In the present embodiment, work machine 10 is a wheel driven backhoe.

Work machine 10 may include a cab 12, and a work system 14 for operating an attachment 16. Attachment 16 is an interchangeable implement designed for performing particular tasks. In the embodiment of FIG. 1, attachment 16 is depicted as a bucket. However, it will be understood that attachment 16 may be any typical interchangeable attachment used in, for example, the agricultural, construction, and forestry industries, such as bale forks, bale spears, pallet forks, a multi-function bucket, a round bale hugger, a debris grapple bucket, or a silage defacer. Work machine 10 is powered by an engine 18, such as a diesel engine.

Cab 12 houses the operator of work machine 10 while operating work machine 10. Located in cab 12 may be a control console 20 for operating work system 14. Control console 20 includes a throttle 22 and an operator command input device 24. Throttle 22 is employed by the operator to set the speed of engine 18, and is configured to provide a throttle position signal accordingly. Operator command input device 24 is configured to provide an operator command signal for directing the motion of attachment 16 based on manual inputs from the operator. As used herein, the term, "command," pertains to an action sought by the operator to be performed by virtue of the operator's manual input to operator command input device 24, such as the operator moving the joy stick for the purpose of commanding attachment 16 to be raised or lowered to a particular position at a particular speed desired by the operator.

Work system 14 may include a frame 26, and on each side of work machine 10, a boom 28, a boom cylinder 30 and a bucket cylinder 32. Work machine 10 also includes a hydraulic system 34 for providing hydraulic power to operate work system 14.

Boom 28 is pivotably connected to frame 26 at one end, and pivotably connected to attachment 16 at the other end. Boom cylinder 30 is coupled to both frame 26 and boom 28, and via hydraulic power from hydraulic system 34, is used to raise and lower boom 28, and hence attachment 16. Boom cylinder 30 is a double-acting hydraulic cylinder, and is controlled by the operator of work machine 10 using operator command input device 24. Bucket cylinder 32 is coupled to both boom 28 and attachment 16, and via hydraulic power from hydraulic system 34, is used to rotate attachment 16 in a curl rotation direction 36 and in a dump rotation direction 38. Bucket cylinder 32 is a double-acting hydraulic cylinder, and is also controlled by the operator of work machine 10 using operator command input device 24. Rotation of attachment 16 in curl direction 36 results from bucket cylinder 32 extension in curl linear direction 40, and rotation of attachment 16 in dump direction 38 results from bucket cylinder retraction in dump linear direction 42. It will be noted that bucket cylinder 32 is so named because many work machine owners/operators commonly use an attachment 16 in the form of a bucket, as is depicted in FIG. 1, and hence, the hydraulic cylinder that is used to rotate attachment 16 has become known in the art as a "bucket cylinder." However, it will be understood that the term, "bucket cylinder," pertains to the hydraulic cylinder used to rotate attachment 16, without regard to the type of attachment 16 mounted to work machine 10.

Figure 2:
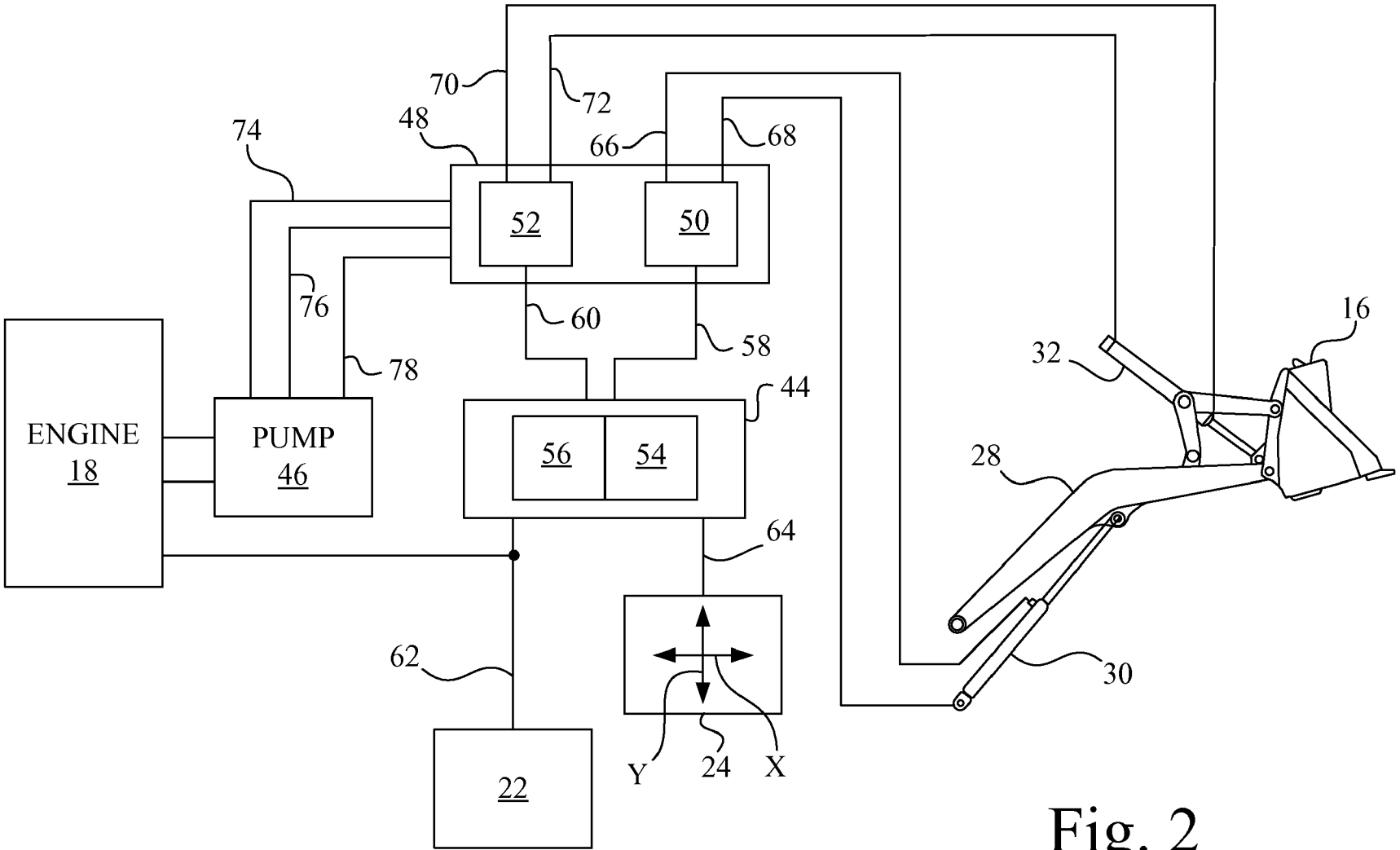
FIG. 2 schematically depicts a hydraulic system and a controller for controlling the hydraulic system in accordance with an embodiment of the present invention.

Referring now to FIG. 2, hydraulic system 34 and a controller 44 for controlling hydraulic system 34 in accordance with an embodiment of the present invention are depicted.

Hydraulic system 34 is configured to, among other things, direct hydraulic flow to boom cylinder 30 and bucket cylinder 32 in response to signals from controller 44. These signals from controller 44 are based on commands from the operator via operator command input device 24 that are received by controller 44. In the present embodiment, operator command input device 24 is a two-axis joy stick, wherein one axis, illustrated in FIG. 2 as an X-axis, pertains to one function, such as rotating attachment 16, and wherein the other axis, illustrated in FIG. 2 as a Y-axis, pertains to another function, such as raising and lowering boom 28 and hence attachment 16.

Hydraulic system 34 includes a variable displacement hydraulic pump 46, such as a swash-plate pump, that is coupled to and driven by engine 18, and a hydraulic valve arrangement 48. Hydraulic system 34 is a pressure compensated load sensing system, and is configured to hydraulically actuate attachment 16 via hydraulic valve arrangement 48. Hydraulic valve arrangement 48 includes a valve module 50 and a valve module 52.

Controller 44 includes a processing unit 54 and a memory 56 communicatively coupled to processing unit 54. Controller 44 is communicatively coupled to valve module 50 via a communications link 58, and is communicatively coupled to valve module 52 via a communications link 60. Controller 44 is communicatively coupled to throttle 22 via a communications link 62, which also communicatively couples throttle 22 to engine 18. Controller 44 is communicatively coupled to operator command input device 24 via communications link 64, which may be capable of transmitting multiple electrical signals to controller 44 in parallel. In the present embodiment, communications links 62 and 64 are control area network (CAN) connection links, although it will be understood that other types of communications links may be employed without departing from the scope of the present invention.

In the present embodiment, processing unit 54 is a microprocessor, and operates by executing program instructions in the form of software stored in memory 56. However, it will be understood that other types of processing elements may be employed in addition to or in place of a microprocessor, without departing from the scope of the present invention. For example, processing unit 54 may take the form of programmable logic circuits or state machines. In addition, it will be understood that other forms of program instructions may also or alternatively be employed, without departing from the scope of the present invention, for example, firmware and/or hardware logic.

Valve module 50 is coupled to boom cylinder 30 via hydraulic lines 66 and 68. Valve module 50 is configured to direct hydraulic flow to extend and retract boom cylinder 30 in order to manipulate attachment 16 by raising and/or lowering boom 28 in response to control signals received from controller 44. Similarly, valve module 52 is coupled to bucket cylinder 32 via hydraulic lines 70 and 72. Valve module 52 is configured to direct hydraulic flow to extend and retract bucket cylinder 32 in order to rotate attachment 16 in response to control signals received from controller 44.

Hydraulic valve arrangement 48 is coupled to pump 46 via hydraulic lines 74, 76 and 78. Hydraulic line 74 is a load sense line, and provides a load sense pressure to pump 46 that is used to control the displacement of pump 46, e.g., by altering a swash-plate angle. Hydraulic line 76 provides pump output pressure and flow to hydraulic valve arrangement 48 for use by valve module 50 and valve module 52. Hydraulic line 78 is a return line that returns hydraulic fluid to pump 46.

Each of valve modules 50 and 52 are post-compensated valve modules, and are configured to mechanically perform flow sharing therebetween, e.g., based on hydraulic pressure. By being "post-compensated," it will be understood that pressure compensation is based on the pressure balance between load sense pressure and a workport pressure of the valve module. The workport pressure pertains to the pressure of the valve module that is directed to boom cylinder 30 and bucket cylinder 32 via hydraulic lines 66, 68, 70 and 72. With a post-compensated valve module, the pump is responsible for maintaining a pressure differential between pump output pressure and workport pressure. In contrast, pre-compensated valve systems perform pressure compensation based on the pressure balance between pump output pressure and valve workport pressure, and the valve is responsible for maintaining a pressure differential between the pump output pressure and workport pressure. Thus, with pre-compensated valve system, the controller that controls such a valve system performs operations to maintain the pressure differential between the pump output pressure and workport pressure, whereas with post-compensated valve systems, a pressure margin may be "built-in" to the system, without requiring the controller to perform operations to maintain such pressure differential. Because the present embodiment employs a post-compensated valve system, controller 44 is not required to control valve modules 50 and 52 in such a manner as to preserve pressure margin.

In addition, because valve modules 50 and 52 perform mechanical flow sharing, controller 44 is not required to do so, and hence is not configured to perform flow sharing, which may reduce the cost and complexity of controller 44 relative to other controllers that perform flow sharing control. Thus, controller 44 is configured to generate and direct control signals to valve modules 50 and 52 in response to operator command without modifying the operator command signals for purposes of flow sharing.

During normal operations of work machine 10 that require the use of attachment 16, the operator moves throttle 22 to a desired position to control engine 18 speed. The output of throttle 22 is a throttle position signal, which may be expressed as a percentage, and which in the present embodiment varies between 0% and 100% throttle, where 0% throttle is engine 18 idle speed, and where 100% speed is engine 18 maximum continuous speed. The throttle position signal is supplied to engine 18 and controller 44 via communications link 62. In the present embodiment, 0% throttle is 900 rpm, 100% throttle is 2400 rpm, and engine speed varies linearly with throttle position.

With engine 18 speed set at the desired value, the operator may employ operator command input device 24 to direct the operations of attachment 16 by moving the joy stick in one or both of the X and Y axes. Operator command input device 24 generates an operator command signal that is provided to controller 44 via communications link 64. The operator command signal is a signal that is employed by controller 44 as an input from the operator, which is used by controller 44 to generate an output that controls one or both of valve modules 50 and 52 in order to control hydraulic flow in response to operator commands. Controller 44 thus receives the operator command signal, and generates a control signal by processing of the operator command signal into a form suitable for use by valve modules 50 and/or 52, and transmits the control signal (which is thus based on the operator command signal) to one or both of valve modules 50 and 52 to direct hydraulic flow to boom cylinder 30 and bucket cylinder 32, respectively, for performing the desired operations with attachment 16.

The operator command signal includes two components, a first command signal component pertaining to boom cylinder 30 operation, and thus valve module 50, and a second command signal component pertaining to bucket cylinder 32 operation, and thus valve module 52. In the present embodiment, each command signal component is in the form of electrical currents in a range of 0 to approximately 1500 mA. Controller 44 processes the incoming command signals, and provides a control signal having a first control signal component directed to valve module 50 and a second control signal component directed to valve module 52, wherein the first control signal component is based on the first command signal component, and the second control signal component is based on the second command signal component.

Each command signal component and corresponding control signal component is used for directing the operations of one of the valve modules 50 and 52 in the present embodiment. In other embodiments, it is considered that more than two valve modules may be employed in hydraulic valve arrangement 48, and/or that multiple hydraulic valve arrangements, each having one or more valve modules, may be employed without departing from the scope of the present invention. In such cases, a command signal component and its corresponding control signal component may be employed for each valve module.

Figure 3A:
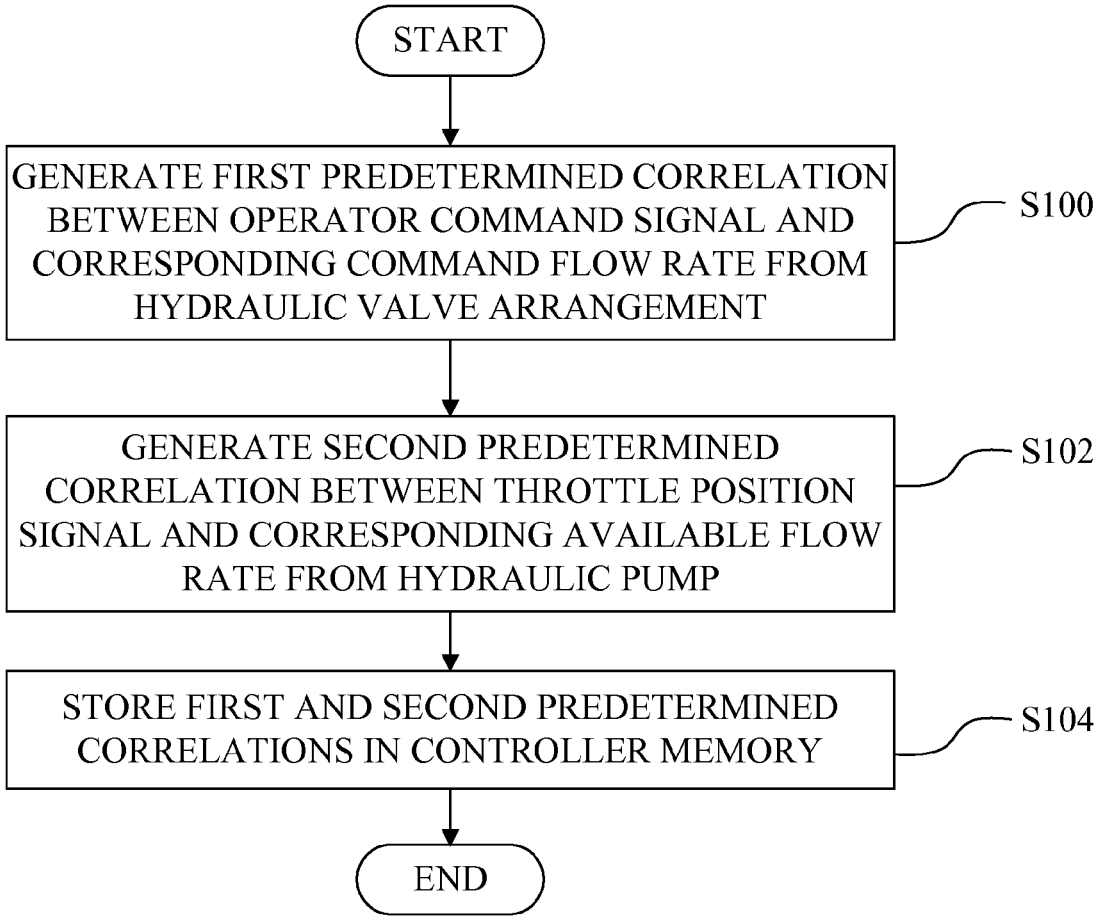
FIGS. 3A and 3B are flow charts depicting a method for controlling a hydraulic system in accordance with an embodiment of the present invention.
Figure 3B:
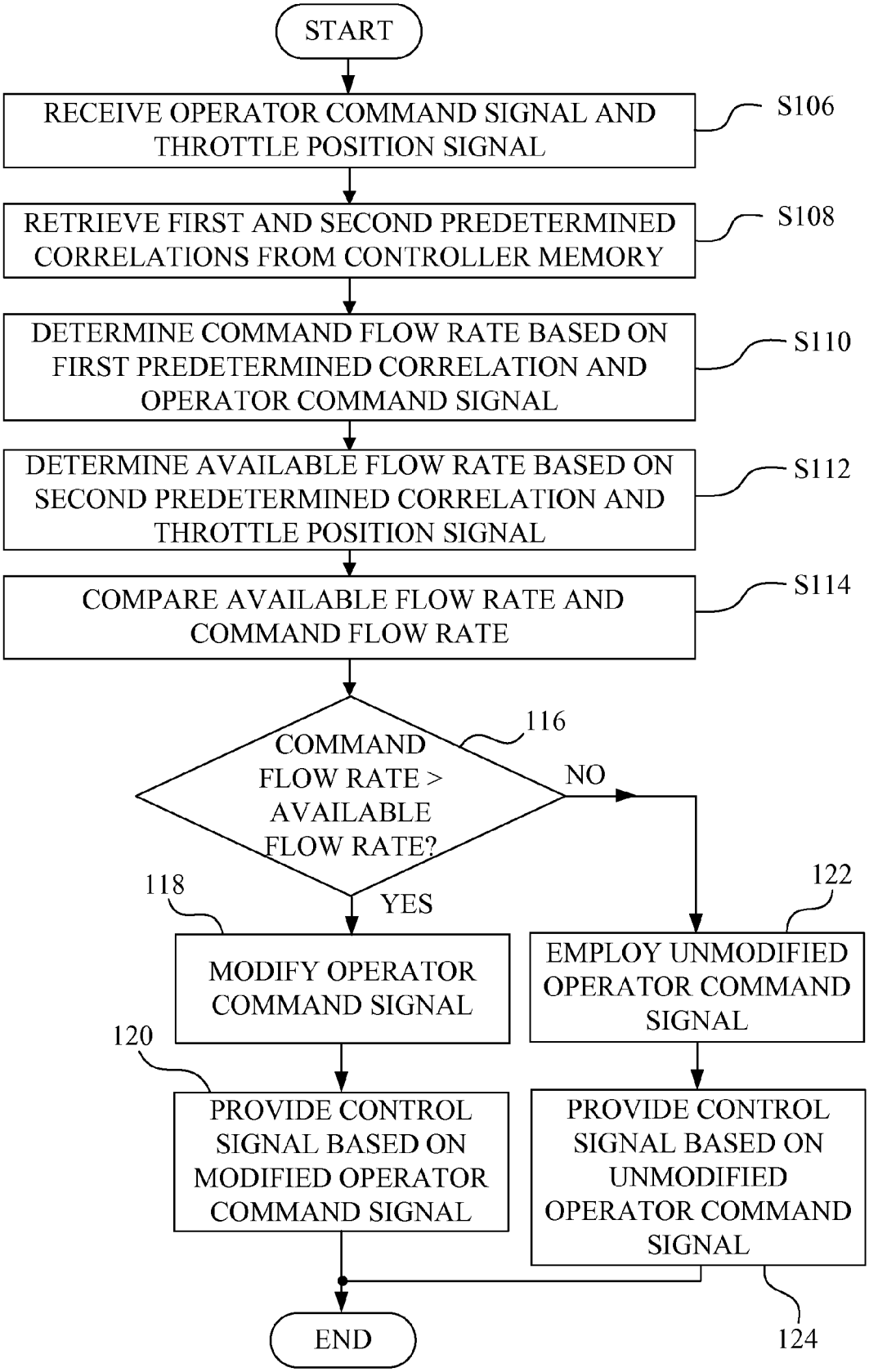

Referring now to FIGS. 3A and 3B, a method for controlling hydraulic system 34 in accordance with an embodiment of the present invention is described with respect to steps S100-S124. In the present embodiment, steps S100-S104 are performed at the factory, e.g., at or before the time of manufacture of controller 44, although it will be understood that steps S100-S104 may be performed at any convenient time without departing from the scope of the present invention. Steps S106-S124 are performed by controller 44 executing program instructions stored in memory 56 during work machine 10 operations that require the use of hydraulic system 34 for performing operations with attachment 16.

At step S100, with reference to FIG. 3A, first predetermined correlations between the operator command signals output by operator command input device 24 and the corresponding command flow rates from hydraulic valve arrangement 48 are generated. One first predetermined correlation is generated for each attachment 16 function, e.g., raising boom 28, lowering boom 28, rotating attachment 16 in curl direction 36 and rotating attachment 16 in dump direction 38. The command flow rate, which corresponds to the operator command signal, is the flow rate that would be delivered by hydraulic valve arrangement 48 via one or both of valve modules 50 and 52 to a corresponding one or both of boom cylinder 30 and bucket cylinder 32 to operate attachment 16 in the absence of pump 46 flow rate limitations. The correlations are referred to as "predetermined" correlations because the correlations are not made by controller 44 on the fly, but rather, as set forth below, are determined prior to executing normal operations of controller 44 during everyday field operation of work machine 10. For example, the correlations may be generated at the factory and stored in memory 56 of controller 44 for subsequent use by controller 44 during the normal operations of work machine 10. By estimating the first and second correlations up front, and then subsequently using those correlations during operation of work machine 10, the additional time associated with performing calculations may be avoided. In addition, complexity of the control algorithm associated with calculating the flows on the fly may be avoided. This may reduce the cost and complexity of controller 44 relative to other controllers, as well as increase the responsiveness controller 44 relative thereto, since the processing demands and time and are lower than if the correlation was made by the controller each time a command is input by the operator of work machine 10.

Figure 4A:
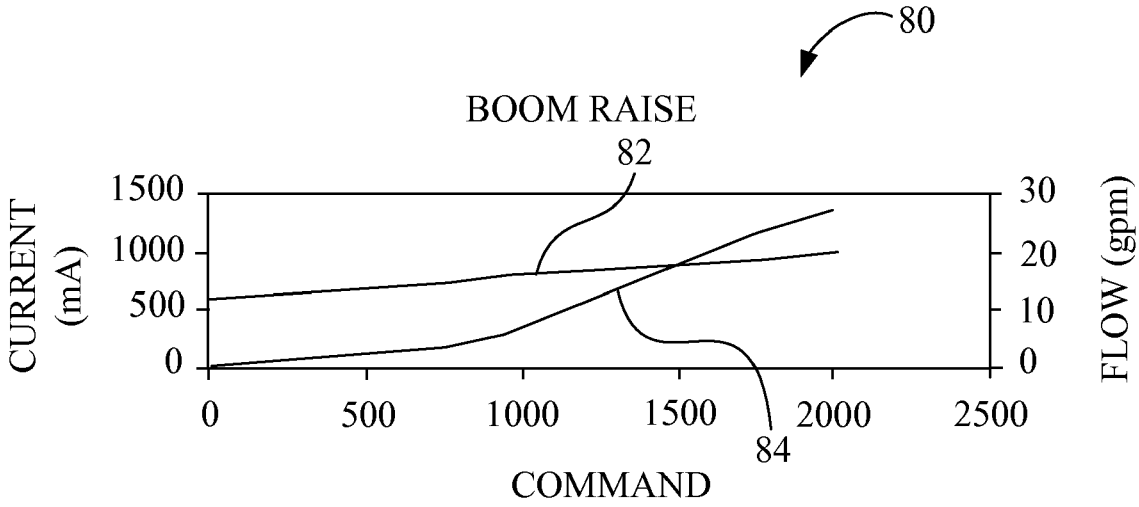
FIGS. 4A and 4B are plots depicting predetermined flow rate correlations and a control signal employed in controlling a hydraulic system in accordance with the embodiment of FIGS. 3A and 3B.

Referring now to FIG. 4A a plot of an exemplary first predetermined correlation 80 is depicted, which correlates a command signal 82 with command flow rate 84 for a boom raise function. The abscissa is a command value, which is in a range of 0-2000 command units, where 2000 corresponds to 100% command input, i.e., the maximum command input. The ordinate for command signal 82 is electrical current in the range of 0-1500 mA, and the ordinate for command flow rate 84 is flow rate in a range of 0-30 gallons per minute (gpm). It is seen that the value of command signal 82 varies from approximately 550 mA at a zero command input to approximately 1000 mA at a command value of 2000, or 100% command input. The value of the command flow rate 84 varies from zero at a zero command input to approximately 29 gpm (gallons per minute) at a command value of 2000, or 100% command input. Correlation 80 may be in the form of a lookup table, equations, or both, or may be in any convenient form accessible by processing unit 54. Similar correlations may be made for each function, e.g., lowering boom 28, rotating attachment 16 in curl direction 36 and rotating attachment 16 in dump direction 38. However, for purposes of illustration, only a single first correlation 80 is depicted.

At step S102, with reference again to FIG. 3A, a second predetermined correlation, which is a correlation between the throttle position signal and a corresponding available flow rate from hydraulic pump 46, is generated. The corresponding available flow rate is the full stroke flow output capability of pump 46 at any given speed of engine 18. As with the first predetermined correlations, the second correlation is referred to as a "predetermined" correlation because the correlation is not made by controller 44 on the fly, but rather, as set forth below, is generated in advance, e.g., at the factory.

Figure 4B:
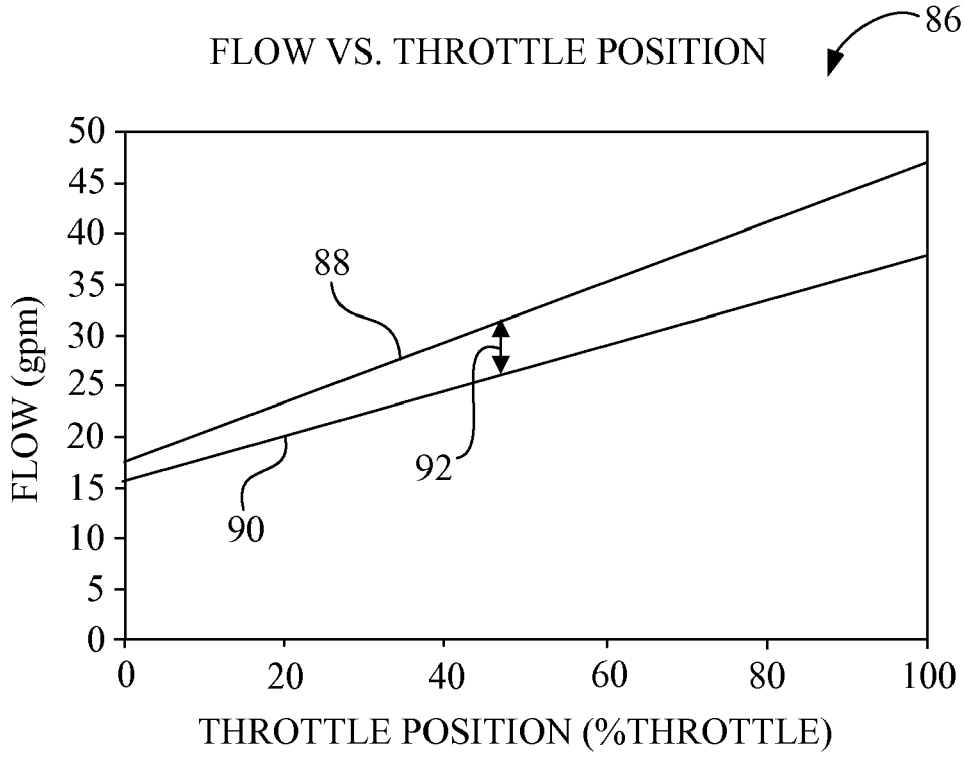

Referring now to FIG. 4B, a plot 86 of an exemplary second predetermined correlation 88 is depicted, which correlates a throttle position signal with corresponding available flow rate. The abscissa is the throttle position signal, which may vary from 0% throttle to 100% throttle, and the ordinate is flow rate in a range of 0-50 gpm. It is seen that the available flow rate varies approximately linearly from about 17.6 gpm at a 0% throttle to 47 gpm at 100% throttle. Correlation 88 may be in the form of a lookup table, equations, or both, or may be in any convenient form accessible by processing unit 54. In other embodiments, it is alternatively considered that engine 18 speed may be employed, e.g., by using an engine 18 speed signal in place of the throttle position signal. Plot 86 also depicts a control signal 90, which may be a result of the present embodiment, as set forth below.

At step S104, with reference again to FIG. 3A, the first predetermined correlation, e.g., correlation 80, and the second predetermined correlation, e.g., correlation 88, are stored in memory 56, e.g., during manufacturing of controller 44, for later access by controller 44 in the course of normal operations of the particular work machine 10 into which memory 56 and/or controller 44 is installed.

In the present embodiment, the process of generating the first and second correlations and storing them in controller 44 ends at step S104. The presently described method embodiment of the present invention picks back up at step S106, which takes place during normal operations of work machine 10, when the operator of work machine 10 performs work using attachment 16.

At step S106, with reference now to FIG. 3B, controller 44 receives an operator command signal from operator command input device 24 and a throttle position signal from throttle 22, e.g., when the operator of work machine 10 actuates operator command input device 24 and throttle 22 in order to perform work using attachment 16.

At step S108, controller 44, in particular processing unit 54, retrieves the first and second predetermined correlations, e.g., correlations 80 and 88, from memory 56 of controller 44.

At step S110, the command flow rate is determined based on the first predetermined correlation and the operator command signal, e.g., correlation 80 and command signal 82. For example, with correlation 80 in the form of a lookup table, the operator command signal 82 may be used as an input to look up the corresponding command flow rate in the lookup table.

At step S112, the available flow rate is determined based on the second predetermined correlation, e.g., correlation 88, and the throttle position signal. For example, with correlation 88 in the form of a lookup table, the throttle position signal may be used as an input to look up the corresponding available flow rate in the lookup table.

At step S114, controller 44 compares the available flow rate and the command flow rate.

At step S116, it is determined whether to modify the operator command signal based on the comparison of the available flow rate and the command flow rate. The operator command signal is modified when command flow rate exceeds the available flow rate, in which case the control signal is based on a modified operator command signal. An unmodified operator command signal is employed when the available flow rate exceeds the command flow rate, e.g., the control signal is based on the original, unmodified operator command signal.

Accordingly, at step S116, if the command flow rate is greater than the available flow rate, process flow is directed to step S118, whereas if the command flow rate is not greater than the available flow rate, process flow is directed to step S122.

At step S118, controller 44 modifies the operator command signal by reducing the magnitude of the commanded flow rate to fall within the available flow rate delivered by pump 46 at the particular engine 18 speed set by throttle 22. The control signal is generated by controller 44 based on the modified operator command signal. In the present embodiment, the modified operator command signal is configured to preserve a predetermined operating margin of hydraulic system 34, and hence, the control signal provided to hydraulic valve arrangement 48 incorporates the predetermined operating margin of hydraulic system 34. The predetermined operating margin pertains to an amount of flow capacity deliverable by pump 46 above that which is delivered by hydraulic valve arrangement 48 to the hydraulic devices operated by hydraulic valve arrangement 48, e.g., boom cylinder 30 and bucket cylinder 32, in response to operator commands.

For example, referring again to FIG. 4B, control signal 90 is depicted in the form of a curve that represents a relationship between throttle position and command flow rate. Control signal 90 is spaced apart from correlation 80, which as set forth above, pertains to the available flow rate from pump 46 as a function of throttle position. The vertical difference, i.e., along the ordinate, between control signal 90 and correlation 80 at any given throttle position is defined by the predetermined operating margin. For example, predetermined operating margin 92 is depicted in FIG. 4B as a line having two arrowheads, wherein the length of the line is indicative of the difference in flow rate as between correlation 80 and control signal 90 at an arbitrary throttle position setting. In the present embodiment, it is seen from FIG. 4B that the predetermined operating margin increases with throttle position, although it will be understood by those skilled in the art that the predetermined operating margin may be constant or vary in other manners, without departing from the scope of the present invention.

In addition, in the present embodiment, control signal 90 represents the sum of individual control signal components. For example, when the operator of work machine 10 is commanding flow to both boom cylinder 30 and bucket cylinder 32, there are two operator command signal components and two corresponding control signal components. In such a case, one command signal component and one corresponding control signal component are associated with boom cylinder 30, the others are associated with bucket cylinder 32; the sum of the two control signal components is represented by control signal 90. However, it will be understood that each control signal component may be separately processed, without departing from the scope of the present invention, e.g., by making individual determinations between available flow rate and command flow rate pertaining to each command signal component and corresponding control signal component.

Further, in the present embodiment, a proportional relationship as between the first command signal component and the second command signal component is maintained as between the first control signal component and the second control signal component. For example, if the operator command signal includes two components, e.g., an operator command signal component calling for a 20 gpm command flow rate to boom cylinder 30 and an operator command signal component calling for a 10 gpm flow rate to bucket cylinder 32, this would represent a total operator command flow rate of 30 gpm. However, if only 25 gpm were available (including the predetermined operating margin) at the given engine 18 speed, control signal 90 would call for 25 gpm total, and the control signal component pertaining to boom cylinder 30 flow would call for 16.67 gpm, whereas the control signal component pertaining to bucket cylinder 32 would call for 8.33 gpm, thus preserving the proportional relationship between the first command signal component and the second command signal component. Nonetheless, it will be understood that other schemes that do not preserve a proportional relationship may be employed without departing from the scope of the present invention.

At step S120, with reference again to FIG. 3B, controller 44 provides control signal 90, which is based on available flow rate and the command flow rate, to valve module 50 and/or valve module 52 of hydraulic valve arrangement 48. For example, when the operator of work machine 10 desires to operate only one of boom cylinder 30 and bucket cylinder 32, and hence, only a single operator command component is received at controller 44, control signal 90 is provided to valve module 50. On the other hand, when the operator desires to operate both boom cylinder 30 and bucket cylinder 32, control signal components associated with each are respectively delivered to valve module 50 and valve module 52.

At step S122, since the command flow rate is not greater than the available flow rate (see step S116) the original, unmodified operator command signal received by controller 44 is employed by controller 44 to generate control signal 90. As set forth above, control signal 90 may be made up of more than one control signal component.

At step S124, controller 44 provides control signal 90 to valve module 50 and/or valve module 52 of hydraulic valve arrangement 48, depending on the command inputs from the operator of work machine 10.

As will be apparent to those skilled in the art, with the present invention, the operator of the work machine may not draw all of the available hydraulic power at a given engine speed, which may enhance the stability of a hydraulic system relative to other hydraulic systems. In addition, adverse impacts on the recovery and stability of the engine, e.g., in response to sudden or unanticipated hydraulic loads, may be reduced relative to other hydraulic systems. In addition, by providing operating margin, adverse impact to the operation of mechanical flow sharing may be avoided, e.g., by not delivering all of the pump 46 flow capacity at a given engine speed. Further, the accuracy of closed loop control features, e.g., parallel lift and anti-spill, may be similarly improved, since an operating margin is provided, which may negate uncontrolled flow starvation to hydraulic system components.

Having described the preferred embodiment, it will become apparent that various modifications can be made without departing from the scope of the invention as defined in the accompanying claims.

The invention claimed is:

1. A method for controlling a hydraulic system, said hydraulic system including an engine-driven hydraulic pump and a hydraulic valve arrangement, comprising:

receiving an operator command signal via an operator command input device;

receiving a throttle position signal from a throttle configured for setting a speed of said engine;

retrieving from a memory a first predetermined correlation between said operator command signal and a corresponding command flow rate from said hydraulic valve arrangement;

retrieving from said memory a second predetermined correlation between said throttle position signal and a corresponding available flow rate from said hydraulic pump;

determining said command flow rate based on said first predetermined correlation and said operator command signal;

determining said available flow rate based on said second predetermined correlation and said throttle position signal; and providing a control signal to said hydraulic valve arrangement based on said available flow rate and said command flow rate.

2. The method of claim 1, further comprising:

comparing said available flow rate and said command flow rate; and determining whether to modify said operator command signal based on the comparison of said available flow rate and said command flow rate.

3. The method of claim 2, further comprising:

modifying said operator command signal based on the comparison of said available flow rate and said command flow rate, wherein said control signal is based on a modified operator command signal.

4. The method of claim 3, wherein said modified operator command signal is configured to preserve a predetermined operating margin of said hydraulic system.

5. The method of claim 2, further comprising:

modifying said operator command signal when said command flow rate exceeds said available flow rate, wherein said control signal is based on a modified operator command signal; and employing an unmodified operator command signal when said available flow rate exceeds said command flow rate, wherein said control signal is based on said unmodified operator command signal.

6. The method of claim 1, wherein said control signal incorporates a predetermined operating margin of said hydraulic system.

7. The method of claim 1, wherein:

said hydraulic system is a pressure compensated load sensing system;

said hydraulic valve arrangement includes at least two post-compensated valve modules configured to mechanically perform flow sharing therebetween;

said operator command signal includes a first command signal component and a second command signal component respectively pertaining to a first of said at least two post-compensated valve modules and a second of said at least two post-compensated valve modules;

said control signal includes a first control signal component directed to said first of said at least two post-compensated valve modules and a second control signal component directed to said second of said at least two post-compensated valve modules, wherein said first control signal component is based on said first command signal component, and said second control signal component is based on said second command signal component.

8. The method of claim 7, wherein a proportional relationship as between said first command signal component and said second command signal component is maintained as between said first control signal component and said second control signal component.

9. The method of claim 1, further comprising:

generating said first predetermined correlation and said second predetermined correlation; and storing said first predetermined correlation and said second predetermined correlation in said memory, said memory being associated with a controller that is configured to control said hydraulic system.

10. A work machine for performing work with an attachment, comprising:

an engine;

a throttle configured to provide a throttle position signal for setting a speed of said engine;

a hydraulic system including an engine-driven hydraulic pump and a hydraulic valve arrangement, said hydraulic system being configured to hydraulically actuate said attachment via said hydraulic valve arrangement;

an operator command input device configured to provide an operator command signal for directing a motion of said attachment;

and a controller, said controller including:

a memory storing a first predetermined correlation between said operator command signal and a corresponding command flow rate from said hydraulic valve arrangement, said memory also storing a second predetermined correlation between said throttle position signal and a corresponding available flow rate from said hydraulic pump; and a processing unit communicatively coupled to said memory, said throttle and said operator command input device, wherein said processing unit is configured to execute program instructions to:

receive said operator command signal from said operator command input device;

receive said throttle position signal from said throttle;

retrieve from said memory said first predetermined correlation and said second predetermined correlation;

determine said command flow rate based on said first predetermined correlation and said operator command signal;

determine said available flow rate based on said second predetermined correlation and said throttle position signal; and provide a control signal to said hydraulic valve arrangement based on said available flow rate and said command flow rate.

11. The work machine of claim 10, further comprising said processing unit being configured to execute instructions to:

compare said available flow rate and said command flow rate; and determine whether to modify said operator command signal based on the comparison of said available flow rate and said command flow rate.

12. The work machine of claim 11, further comprising said processing unit being configured to execute instructions to:

modify said operator command signal based on the comparison of said available flow rate and said command flow rate, wherein said control signal is based on a modified operator command signal.

13. The work machine of claim 11, further comprising said processing unit being configured to execute instructions to:

modify said operator command signal when said command flow rate exceeds said available flow rate, wherein said control signal is based on a modified operator command signal; and employ an unmodified operator command signal when said available flow rate exceeds said command flow rate, wherein said control signal is based on said unmodified operator command signal.

14. The work machine of claim 10, wherein said control signal incorporates a predetermined operating margin of said hydraulic system.

15. The work machine of claim 10, wherein:

said hydraulic system is a pressure compensated load sensing system;

said hydraulic valve arrangement includes at least two post-compensated valve modules configured to mechanically perform flow sharing therebetween;

said operator command signal includes a first command signal component and a second command signal component respectively pertaining to a first of said at least two post-compensated valve modules and a second of said at least two post-compensated valve modules;

said control signal includes a first control signal component directed to said first of said at least two post-compensated valve modules and a second control signal component directed to said second of said at least two post-compensated valve modules, wherein said first control signal component is based on said first command signal component, and said second control signal component is based on said second command signal component.

16. A controller for controlling a hydraulic system, said hydraulic system including an engine-driven hydraulic pump and a hydraulic valve arrangement controlled in response to an operator command signal from an operator command input device, wherein a speed of said engine is set based on a throttle position signal from a throttle, comprising:

a memory storing a first predetermined correlation between said operator command signal and a corresponding command flow rate from said hydraulic valve arrangement, said memory also storing a second predetermined correlation between said throttle position signal and a corresponding available flow rate from said hydraulic pump; and a processing unit communicatively coupled to said memory, said throttle and said operator command input device, wherein said processing unit is configured to execute program instructions to:

receive said operator command signal from said operator command input device;

receive said throttle position signal from said throttle;

retrieve from said memory said first predetermined correlation and said second predetermined correlation;

determine said command flow rate based on said first predetermined correlation and said operator command signal;

determine said available flow rate based on said second predetermined correlation and said throttle position signal; and provide a control signal to said hydraulic valve arrangement based on said available flow rate and said command flow rate.

17. The controller of claim 16, further comprising said processing unit being configured to execute instructions to:

compare said available flow rate and said command flow rate; and determine whether to modify said operator command signal based on the comparison of said available flow rate and said command flow rate.

18. The controller of claim 17, further comprising said processing unit being configured to execute instructions to:

modify said operator command signal based on the comparison of said available flow rate and said command flow rate, wherein said control signal is based on a modified operator command signal.

19. The work machine of claim 17, further comprising said processing unit being configured to execute instructions to:

modify said operator command signal when said command flow rate exceeds said available flow rate, wherein said control signal is based on a modified operator command signal; and employ an unmodified operator command signal when said available flow rate exceeds said command flow rate, wherein said control signal is based on said unmodified operator command signal.

20. The work machine of claim 16, wherein said control signal incorporates a predetermined operating margin of said hydraulic system.

* * * * *